US006694961B2

(12) United States Patent
Miura et al.

(10) Patent No.: US 6,694,961 B2
(45) Date of Patent: Feb. 24, 2004

(54) INTERNAL COMBUSTION ENGINE

(75) Inventors: Hajime Miura, Tokyo (JP); Makoto Yasunaga, Yokohama (JP)

(73) Assignee: Nissan Motor Co., Ltd., Yokohama (JP)

( * ) Notice: Subject to any disclaimer, the term of this patent is extended or adjusted under 35 U.S.C. 154(b) by 66 days.

(21) Appl. No.: 10/072,913

(22) Filed: Feb. 12, 2002

(65) Prior Publication Data

US 2002/0134364 A1 Sep. 26, 2002

(30) Foreign Application Priority Data

Mar. 26, 2001 (JP) ..... 2001-087526

(51) Int. Cl.[7] ..... F02D 41/00
(52) U.S. Cl. ..... 123/681; 123/188.3
(58) Field of Search ..... 123/681, 478, 123/480, 406.47, 680, 188.3, 188.7, 188.8

(56) References Cited

U.S. PATENT DOCUMENTS 4,301,780 A * 11/1981 Hoshi ..... 123/486
4,362,134 A * 12/1982 Worthen ..... 123/188.3
4,911,131 A * 3/1990 Nakaniwa et al. ..... 123/492
5,113,833 A 5/1992 Nagano et al. ..... 123/491
5,427,069 A * 6/1995 Tomisawa et al. ..... 123/478
5,551,392 A * 9/1996 Yamaji et al. ..... 123/306
6,032,652 A * 3/2000 Nozawa et al. ..... 123/478
6,453,867 B1 * 9/2002 Ruhland et al. ..... 123/188.3

FOREIGN PATENT DOCUMENTS

JP 2000-38974 2/2000
JP 2000-313672 11/2000

* cited by examiner

*Primary Examiner*—Mahmoud Gimie
(74) *Attorney, Agent, or Firm*—Foley & Lardner

(57) ABSTRACT

An internal combustion engine including a combustion chamber, an intake air passage communicated with the combustion chamber, an intake valve having a thermal insulator at an air-exposure portion thereof which is opposed to the intake air passage, a fuel injector disposed within the intake air passage and operative to inject an amount of fuel toward the air-exposure portion of the intake valve at a fuel injection timing, and a controller in communication with the fuel injector. The controller is programmed to set the fuel injection timing of the fuel injector to an engine intake stroke.

20 Claims, 6 Drawing Sheets

INTERNAL COMBUSTION ENGINE

BACKGROUND OF THE INVENTION

The present invention relates to an internal combustion engine, and specifically to an internal combustion engine in which fuel is injected into an intake air passage.

There have been proposed internal combustion engines having a plurality of engine cylinders and a fuel injector disposed in an intake air passage communicated with each engine cylinder. In the conventional arts, generally, for the purpose of facilitating atomization of fuel, the fuel is injected toward a valve head of an intake valve at an engine exhaust stroke. Further, for the purpose of improving an air-fuel mixture generation, there has been proposed a fuel injector capable of atomizing fuel to particles having a relatively small particle diameter. Japanese Patent Application First Publication No. 2000-38974 discloses an improved fuel injector for atomizing fuel to fine particles.

U.S. Pat. No. 5,113,833 discloses a fuel injector capable of generating an atomized fuel having a particle diameter of 80–90 $\mu$m. A fuel injection timing of the fuel injector is set to an engine intake stroke when a temperature of an engine cooling water is low, and is shifted from the engine intake stroke to an engine exhaust stroke as the engine cooling water temperature increases. The related art contemplates preventing the fuel from adhering to a peripheral wall of the intake air passage and flowing down therealong into the engine cylinder upon injecting the fuel at the engine exhaust stroke in a cool state of the engine.

Japanese Patent Application First Publication No. 2000-313672 discloses an internal combustion engine in which an intake valve made of ceramic is utilized.

SUMMARY OF THE INVENTION

When the fuel is injected toward the intake valve head at the engine exhaust stroke, atomization of the fuel is facilitated. However, heat required for vaporizing the fuel injected, namely, latent heat of vaporization of the fuel injected, is taken from the intake valve head. There is a demand to positively take the latent heat of vaporization of the injected fuel from the intake air in the intake air passage and reduce a temperature of the intake air flowing into the engine cylinder to thereby suppress an engine knock.

In the internal combustion engine of U.S. Pat. No. 5,113,833, the fuel injection timing of the fuel injector is set to the intake stroke when the engine is in a cool state, namely, the temperature of the engine cooling water is low. When the engine is warmed up, the fuel injection timing is shifted from the intake stroke to the exhaust stroke. At this time, latent heat of vaporization of the fuel injected to the intake valve is mainly taken from the intake valve. Therefore, a temperature of the intake air in the intake air passage cannot be reduced. In addition, the related art aims at improving the air-fuel mixture generation in the cool state of the engine by setting the fuel injection timing to the intake stroke. It is not suggested by the related art to positively take the latent heat of vaporization of the injected fuel from the intake air in an engine operating range in which knocking occurs, in order to reduce the temperature of the intake air in the intake air passage.

Further, the ceramic intake valve as described in Japanese Patent Application First Publication No. 2000-313672 has an effect of thermal insulation. However, merely application of the ceramic intake valve to internal combustion engines will fail to take latent heat of vaporization of the injected fuel from an intake air in an intake air passage and sufficiently reduce a temperature of the intake air.

An object of the present invention is to provide an internal combustion engine capable of reducing a temperature of an intake air in an intake air passage to thereby suppress knocking.

According to one aspect of the present invention, there is provided an internal combustion engine, comprising:

a combustion chamber;

an intake air passage communicated with the combustion chamber;

an intake valve having a thermal insulator at an air-exposure portion thereof which is opposed to the intake air passage, the intake valve being operative to establish fluid communication between the combustion chamber and the intake air passage and prevent the fluid communication therebetween;

a fuel injector operative to inject an amount of fuel toward the air-exposure portion of the intake valve at a fuel injection timing, the fuel injector being disposed within the intake air passage; and a controller in communication with the fuel injector and programmed to set the fuel injection timing of the fuel injector to an engine intake stroke.

According to a further aspect of the present invention, there is provided an internal combustion engine, comprising:

a combustion chamber;

an intake air passage communicated with the combustion chamber;

an intake valve having a thermal insulator at an air-exposure portion thereof which is opposed to the intake air passage, the intake valve being operative to establish fluid communication between the combustion chamber and the intake air passage and prevent the fluid communication therebetween;

a fuel injector operative to inject an amount of fuel toward the air-exposure portion of the intake valve at a fuel injection timing, the fuel injector being disposed within the intake air passage; and control means, in communication with the fuel injector, for setting the fuel injection timing of the fuel injector to an engine intake stroke on the basis of an engine load.

According to another aspect of the present invention, there is provided a method of controlling fuel injection for knock suppression in an internal combustion engine which has an intake air passage, an intake valve having an air-exposure portion opposed to the intake air passage, and a fuel injector adapted to inject an amount of fuel toward the air-exposure portion of the intake valve, the method comprising:

determining whether or not the engine operates in a warmed-up state;

determining whether or not the engine operates in a knock range under condition that the engine operates in the warmed-up state; and setting a fuel injection timing at which the fuel injector injects the amount of fuel, to an engine intake stroke when it is determined that the engine operates in the knock range.

BEST MODE FOR CARRYING OUT THE INVENTION

Figure 1A:
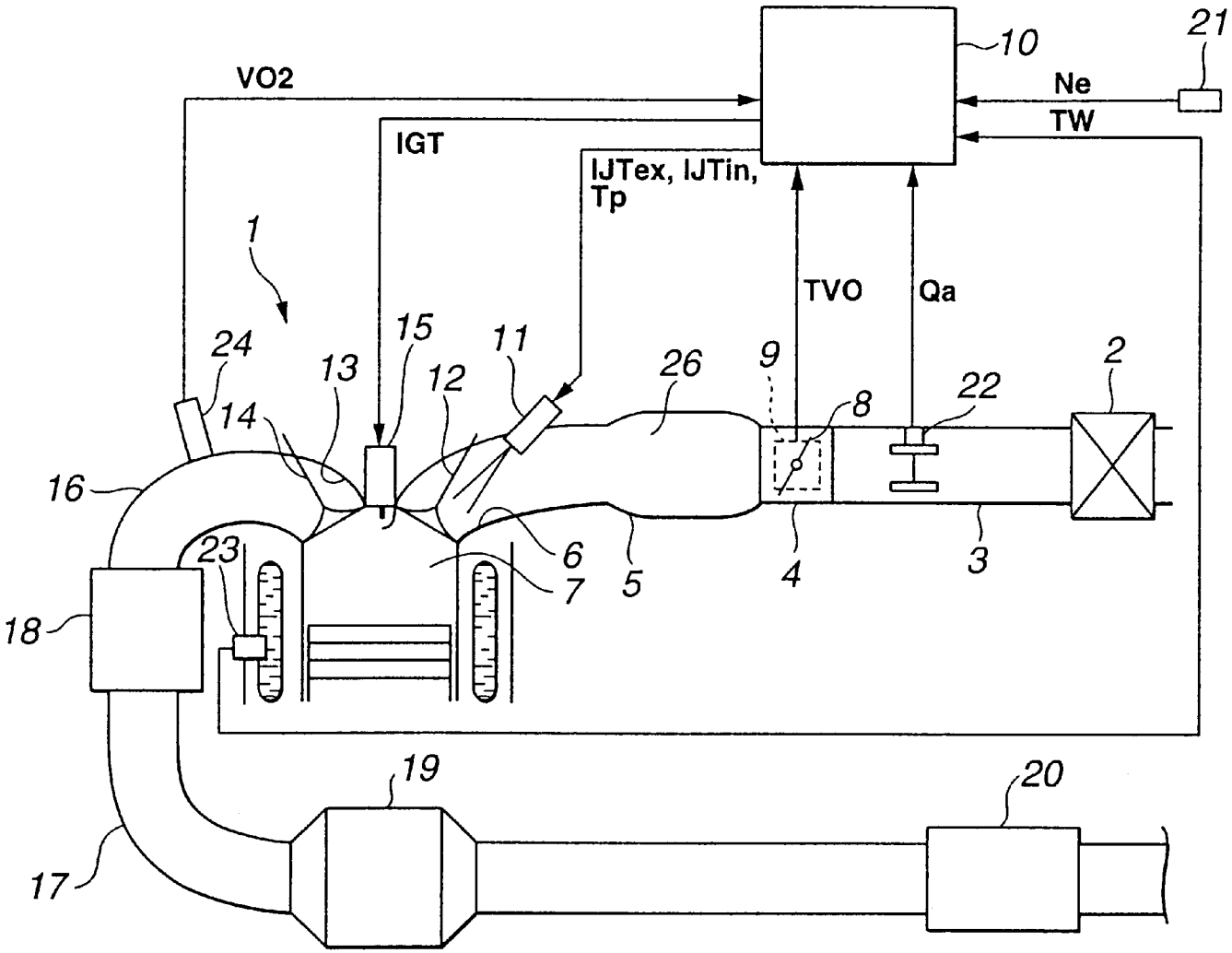
FIG. 1A is a schematic diagram illustrating an internal combustion engine of a first embodiment of the present invention.
Figure 1B:
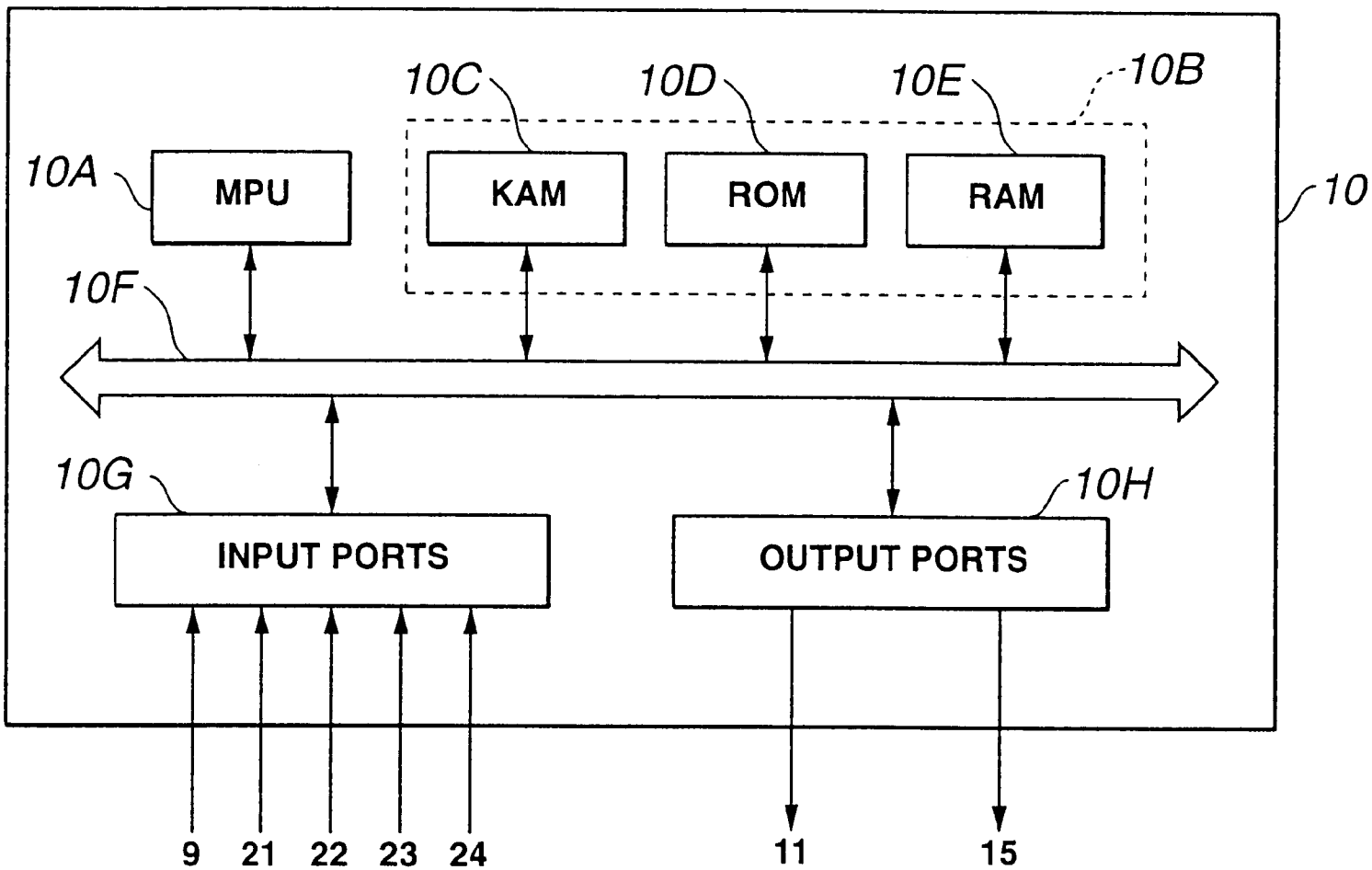
FIG. 1B is a block diagram of a controller.

Referring now to FIGS. 1A and 1B, an internal combustion engine of a first embodiment of the present invention is explained. Internal combustion engine 1 is a multi-cylinder four stroke spark ignition engine including a plurality of cylinders, one of which is shown in FIG. 1A. Internal combustion engine 1 includes combustion chamber 7 into which intake air purified at air cleaner 2 is introduced through intake pipe 3, throttle chamber 4, intake manifold 5 and intake port 6. An amount of the intake air introduced into combustion chamber 7 is controlled by operating throttle valve 8 disposed within throttle chamber 4. Throttle valve 8 is in communication with controller 10 and controlled so as to adjust the position, namely, the opening degree, based on signal output from controller 10. Throttle position sensor 9 is in communication with controller 10 and detects the position of throttle valve 8 and generates signal TVO indicative of the detected position of throttle valve 8.

Fuel injector 11 is disposed at intake port 6 so as to inject fuel into intake air passage 26 formed by intake port 6 and intake manifold 5. Intake valve 12 is disposed so as to open and close intake port 6 in synchronization with rotation of a crankshaft. Intake valve 12 thus operates so as to establish fluid communication between combustion chamber 7 and intake air passage 26 and prevent the fluid communication therebetween. Exhaust valve 14 is disposed so as to open and close exhaust port 13 via which combustion chamber 7 is communicated with exhaust manifold 16.

Spark plug 15 is disposed within combustion chamber 7 so as to ignite an air-fuel mixture of the intake air introduced into combustion chamber 7 and the fuel injected by fuel injector 11. Spark plug 15 is coupled with controller 10 and controlled so as to ignite the air-fuel mixture at a preset ignition timing based on signal output IGT from controller 10. The preset ignition timing is a minimum spark advance for best torque (MBT). Burnt gas generated upon combustion of the air-fuel mixture is discharged therefrom to atmosphere via exhaust port 13, exhaust manifold 16 and exhaust pipe 17. Catalytic converters 18 and 19 and muffler 20 are disposed in exhaust pipe 17.

Figure 2:
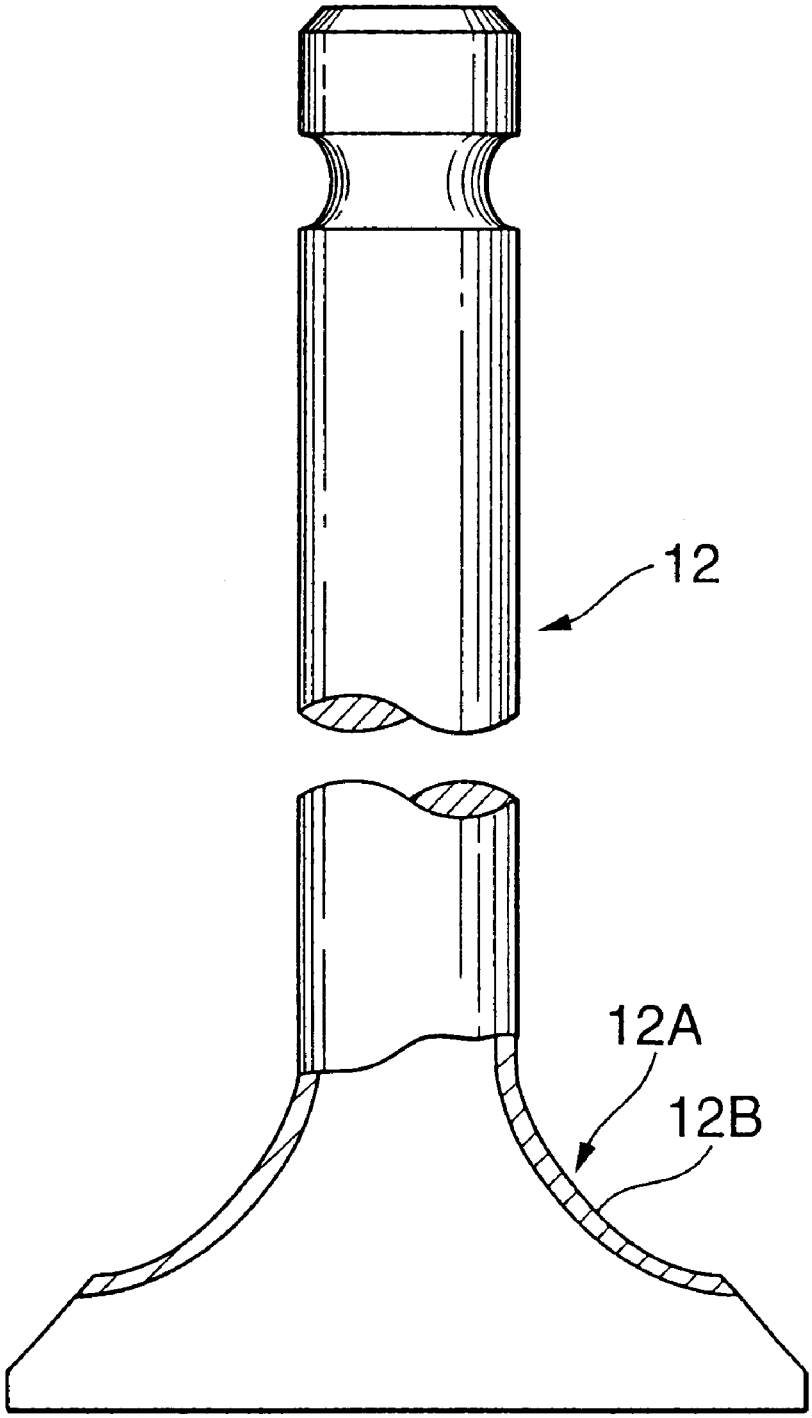
FIG. 2 is a schematic diagram, partially in section, illustrating an intake valve.

Fuel injector 11 is disposed on an upstream side of intake port 6 and in communication with controller 10 so as to be activated by controller 10 to inject the fuel toward intake valve 12. Specifically, fuel injector 11 is so arranged as to inject the fuel toward valve head 12A, shown in FIG. 2, of intake valve 12. As illustrated in FIG. 2, valve head 12A of intake valve 12 has thermal insulator 12B. Thermal insulator 12B is disposed in at least an air-exposure portion of valve head 12A which is exposed to the intake air flowing through intake air passage 26. Thermal insulator 12B may be in the form of a layer or coating made of a suitable thermal insulating material such as ceramic and resin. Otherwise, intake valve 12 as a whole may be made of ceramic or resin.

Fuel injector 11 is so designed as to atomize fuel to fine particles having a particle diameter smaller than a particle size of ordinary particles of fuel atomized. Specifically, the fine particles have an average particle diameter (Sauter's mean droplet diameter) of not more than 100 $\mu$m, preferably not more than 80 $\mu$m and more preferably approximately 70 $\mu$m. In contrast, the ordinary particles of the fuel atomized by the conventional fuel injectors have an average particle diameter of approximately 110 $\mu$m. Fuel injector 11 can facilitate atomization of the fuel injected, serving for improving emission which is caused upon injecting the fuel at engine intake stroke IJTin as described later. The facilitated atomization of the fuel also can promote taking the latent heat from the intake air to thereby reduce a temperature of the intake air. The atomization to the fine particles can be achieved by improving a structure of a fuel injector such as to introduce assist air into an orifice of the fuel injector or form multiple orifices in the fuel injector.

Engine 1 has various sensors detecting parameters relative to engine operating conditions and generating signals indicative of the parameters detected, in addition to throttle position sensor 9. Various sensors include crank angle sensor 21 detecting engine revolution number Ne and generating a signal indicative of engine revolution number Ne detected, air flow meter 22 detecting amount Qa of the intake air introduced into intake pipe 3 and generating a signal indicative of intake air amount Qa detected, coolant temperature sensor 23 detecting temperature TW of an engine cooling water and generating a signal indicative of coolant temperature TW detected, and oxygen sensor 24 detecting exhaust air-fuel ratio (A/F) VO2 in exhaust manifold 16 and generating a signal indicative of exhaust A/F VO2 detected. These sensors communicate with controller 10.

As illustrated in FIG. 1B, controller 10 includes microprocessor unit (MPU) 10A in communication with various computer-readable storage media 10B. Computer-readable storage media 10B may include various types of volatile and non-volatile memory such as keep-alive memory (KAM) 10C, read only memory (ROM) 10D, and random access memory (RAM) 10E. Computer-readable storage media 10B communicate with microprocessor unit 10A via address and data bus 10F. Microprocessor unit 10A processes values corresponding to parameters Ne, Qa, TW and VO2 indicated by the signals received from those sensors 21, 22, 23 and 24 through input ports 10G in accordance with data and instructions stored in computer-readable storage media 10B. Microprocessor unit 10A generates control and command signals which are transmitted via output ports 10H to actuators of fuel injector 11 and spark plug 15.

Controller 10 is programmed to determine amount Tp of fuel to be injected by fuel injector 11 and set fuel injection timing IJT of fuel injector 11, based on the signals from sensors 21, 22, 23 and 24. Fuel injection amount Tp is determined by calculating a basic fuel injection amount based on intake air amount Qa and engine revolution number Ne, and then calibrating the basic fuel injection amount using exhaust A/F VO2 such that the exhaust A/F is kept at a preset A/F, for instance, the stoichiometric A/F in conventional engines and lean A/F (approx. 18) in lean burn engines. If engine 1 is not in a warmed-up state, the temperature of the engine cooling water is calibrated depending mainly on coolant temperature TW, and engine 1 keeps self-rotation.

Basically, fuel injection timing IJT is set based on intake air amount Qa and engine revolution number Ne. Controller 10 is programmed to set fuel injection timing IJT to engine intake stroke IJTin in response to the signal from sensor 22 indicating that intake air amount Qa is more than threshold value QaT. When intake air amount Qa is more than threshold value QaT, engine 1 operates in a knock range in which knocking is likely to occur. In order to prevent the occurrence of knocking, fuel injection timing IJT is set to engine intake stroke IJTin. On the other hand, controller 10 is programmed to set fuel injection timing IJT to engine exhaust stroke IJTex in response to the signal from sensor 22 indicating that intake air amount Qa is not more than threshold value QaT. When intake air amount Qa is not more than threshold value QaT, engine 1 operates out of the knock range. In this case, fuel injection timing IJT is set to engine exhaust stroke IJTex in order to have a sufficient time to vaporize the injected fuel by a moment the injected fuel is introduced into combustion chamber 7.

Owing to the setting of fuel injection timing IJT to engine intake stroke IJTin at the engine warmed-up state and the use of fuel injector 11 atomizing the fuel to the fine particles as described above, the injected fuel can be readily entrained by the intake air flow and facilitated to enter into combustion chamber 7 without staying within intake air passage 26*a*. This causes reduction of a temperature of the intake air. It was found from results of the inventors' experiment in which fuel was injected by fuel injector 11 at engine intake stroke IJTin, that a temperature of the intake air at the intake port decreased by 7° C. to 15° C. as compared with a case where fuel was injected at engine exhaust stroke IJTex using the conventional fuel injector. Further, with provision of thermal insulator 12B at the air-exposure portion of intake valve head 12A, the latent heat of vaporization of the fuel injected can be taken from the intake air within intake air passage 26. This can reduce the temperature of the intake air, serving for suppressing occurrence of knocking.

If the fuel is injected at engine intake stroke IJTin, a time for vaporization of the injected fuel will be insufficient as compared with a case where the fuel is injected at engine exhaust stroke IJTex. Further, as engine revolution number Ne becomes larger, a time from a moment the fuel is injected to a moment the injected fuel is introduced into combustion chamber 7 becomes shorter. Therefore, a uniform air-fuel mixture will fail to be generated in a high revolution range where engine revolution number Ne is large, so that HC emission will increase. In engine 1 of the present invention, controller 10 is programmed to advance fuel injection timing IJT set to engine intake stroke IJTin, as engine revolution number Ne increases. Namely, as engine revolution number Ne increases, fuel injection timing IJT is advanced toward the engine exhaust stroke IJTex side within a region of engine intake stroke IJTin. The advance of fuel injection timing IJT may be continuously conducted or may be stepwise carried out after a moment engine revolution number Ne reaches a threshold value. Owing to the advance of fuel injection timing IJT, generation of the uniform air-fuel mixture can be ensured, so that the engine output and the emission control can be improved.

Further, it was recognized from results of the inventors' experiment that as fuel injection timing IJT was closer to a late stage of engine intake stroke IJTin, an effect of reducing a temperature of the intake air was further enhanced. It is preferable in this embodiment to set fuel injection timing IJT closer to the late stage of engine intake stroke IJTin to such as extent that a uniform air-fuel mixture can be generated. In this case, reduction of the temperature of the intake air can be optimized, and generation of the uniform air-fuel mixture can be attained.

Figure 3:
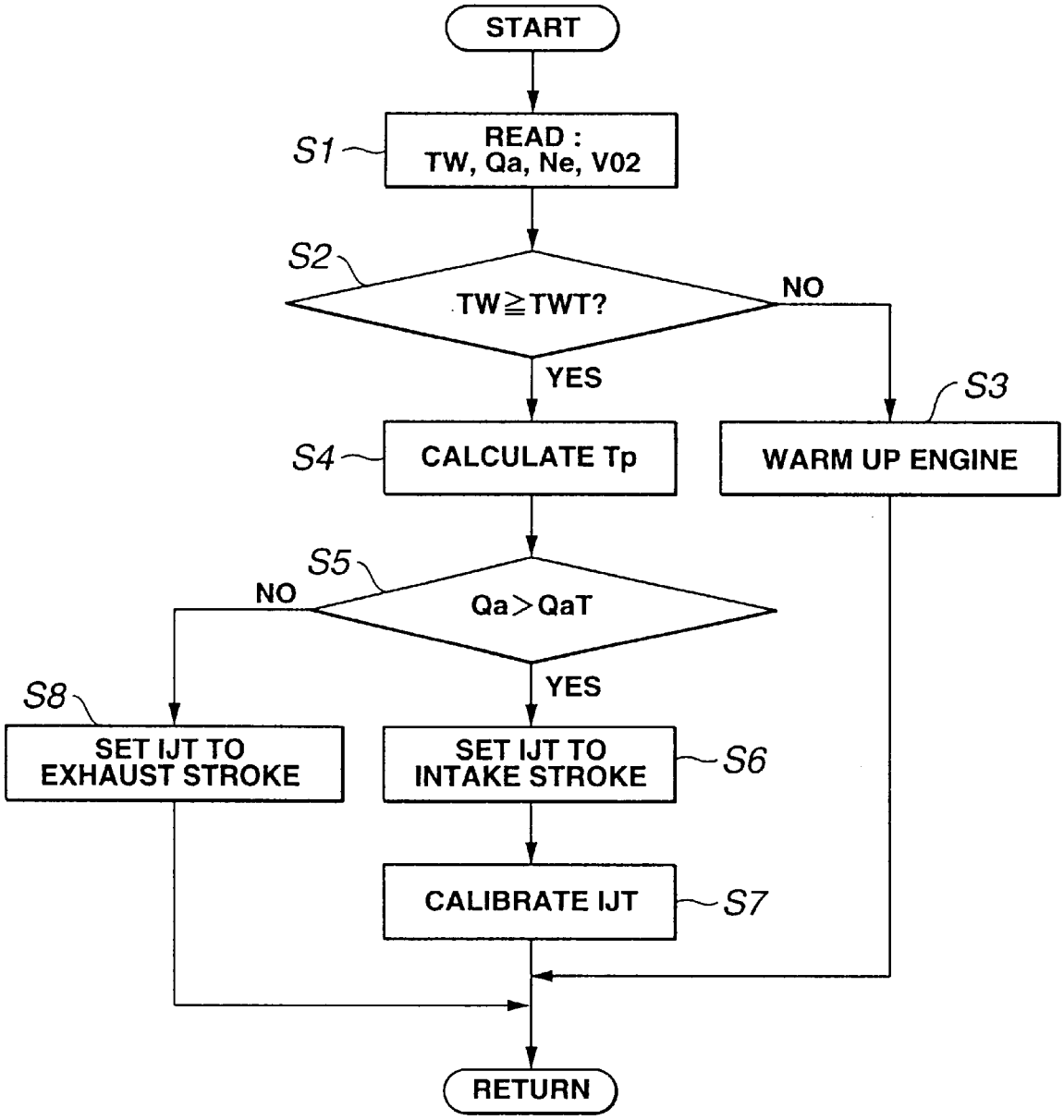
FIG. 3 is a flowchart illustrating a method of controlling fuel injection which is used in the first embodiment of the present invention.

Referring to FIG. 3, a flow of the fuel injection control implemented in the first embodiment will be explained hereinafter. Logic flow starts and goes to block S1 at which an operating condition of engine 1 is determined by reading engine revolution number Ne, intake air amount Qa, coolant temperature TW and exhaust A/F VO2. The logic then goes to decision block S2 at which an interrogation is made whether or not coolant temperature TW is not less than threshold value TWT. If the interrogation made at decision block S2 is in negative indicating that coolant temperature TW is lower than threshold value TWT, it is determined that engine 1 does not operate in a warmed-up state and the logic goes to block S3. At block S3, a fuel injection amount and a fuel injection timing appropriate for promotion of warm-up of engine 1 are calculated. If the interrogation made at decision block S2 is in affirmative, it is determined that engine 1 operates in a warmed-up state and the logic goes to block S4. At block S4, fuel injection amount Tp is calculated as follows. First, a basic fuel injection amount is calculated based on engine revolution number Ne and intake air amount Qa. Then, the basic fuel injection amount is calibrated using exhaust A/F VO2 such that exhaust A/F VO2 is kept at the preset A/F. The logic then goes to decision block S5 at which an interrogation is made whether or not intake air amount Qa is more than threshold value QaT. Intake air amount Qa represents engine load. If the interrogation made at decision block S5 is in affirmative, it is determined that engine 1 operates in a knock range where knocking is likely to occur. The logic then goes to block S6. At block S6, fuel injection timing IJT is set to engine intake stroke IJTin so as to positively take the latent heat of vaporization of the injected fuel from the intake air in intake air passage 26. Then, at block S7, fuel injection timing IJT set at block S6 is calibrated using engine revolution number Ne. Specifically, as engine revolution number Ne increases, fuel injection timing IJT set to engine intake stroke IJTin is advanced toward the exhaust stroke IJTex side within a region of engine intake stroke IJTin. If the interrogation made at decision block S5 is in negative indicating that intake air amount Qa is not more than threshold value QaT, it is determined that engine 1 operates out of the knock range and the logic goes to block S8. At block S8, fuel injection timing IJT is set to engine exhaust stroke IJTex. When fuel injection timing IJT is set to engine exhaust stroke IJTex, vaporization of the fuel can be ensured since a period from the moment the fuel is injected to the moment the fuel injected flows into combustion chamber 7 is sufficiently prolonged. In such a case, a uniform air-fuel mixture can be generated, so that emission can be improved, specifically, HC in the exhaust gas can be reduced.

The method of controlling the fuel injection in the internal combustion engine of the invention can prevent occurrence of knocking by shifting fuel injection timing IJT to engine intake stroke IJTin upon the engine being in the knock range and improve emission by shifting fuel injection timing IJT to engine exhaust stroke IJTex upon the engine being out of the knock range.

Figure 4:
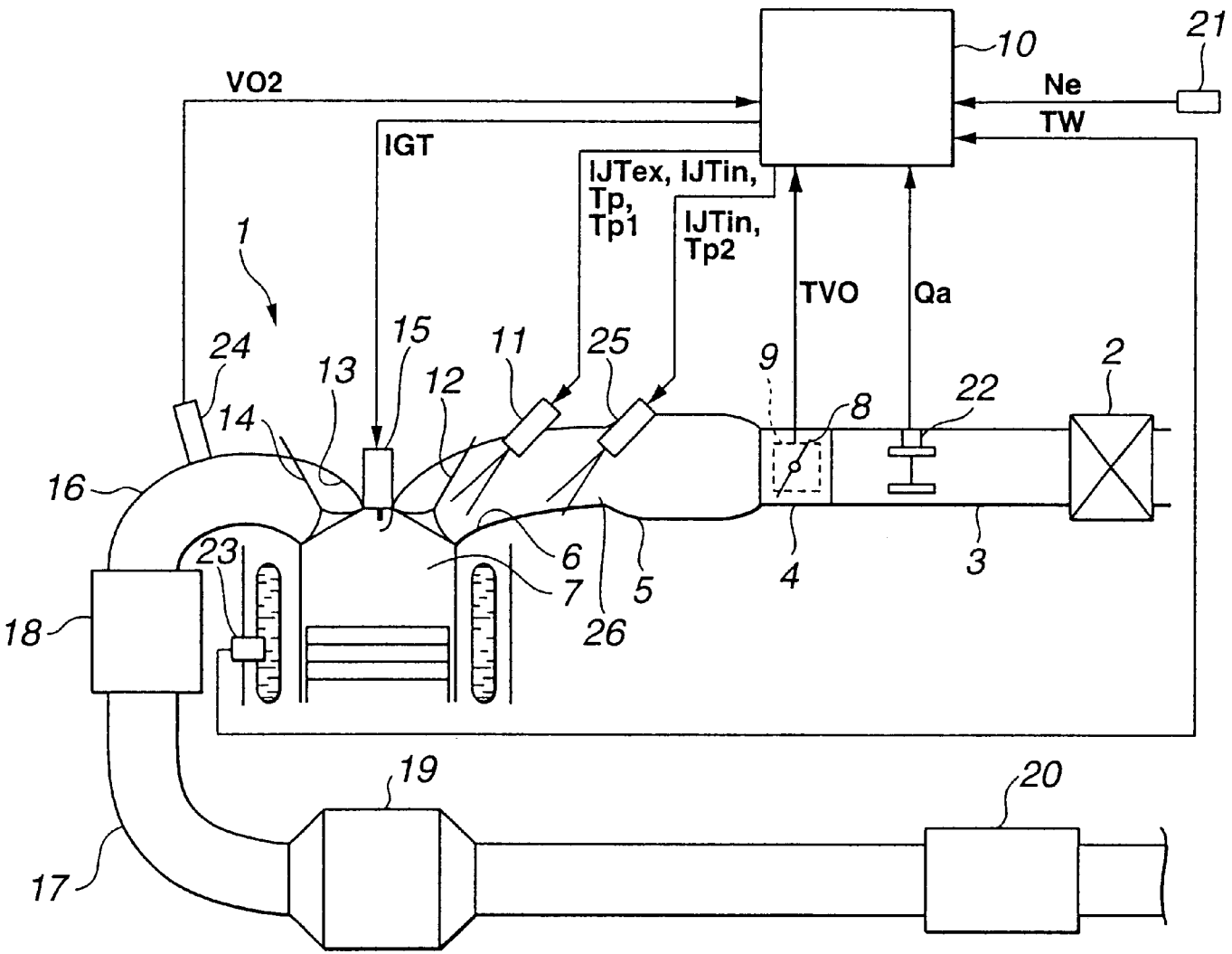
FIG. 4 is a schematic diagram similar to FIG. 1A, but illustrating a second embodiment of the present invention.
Figure 5:
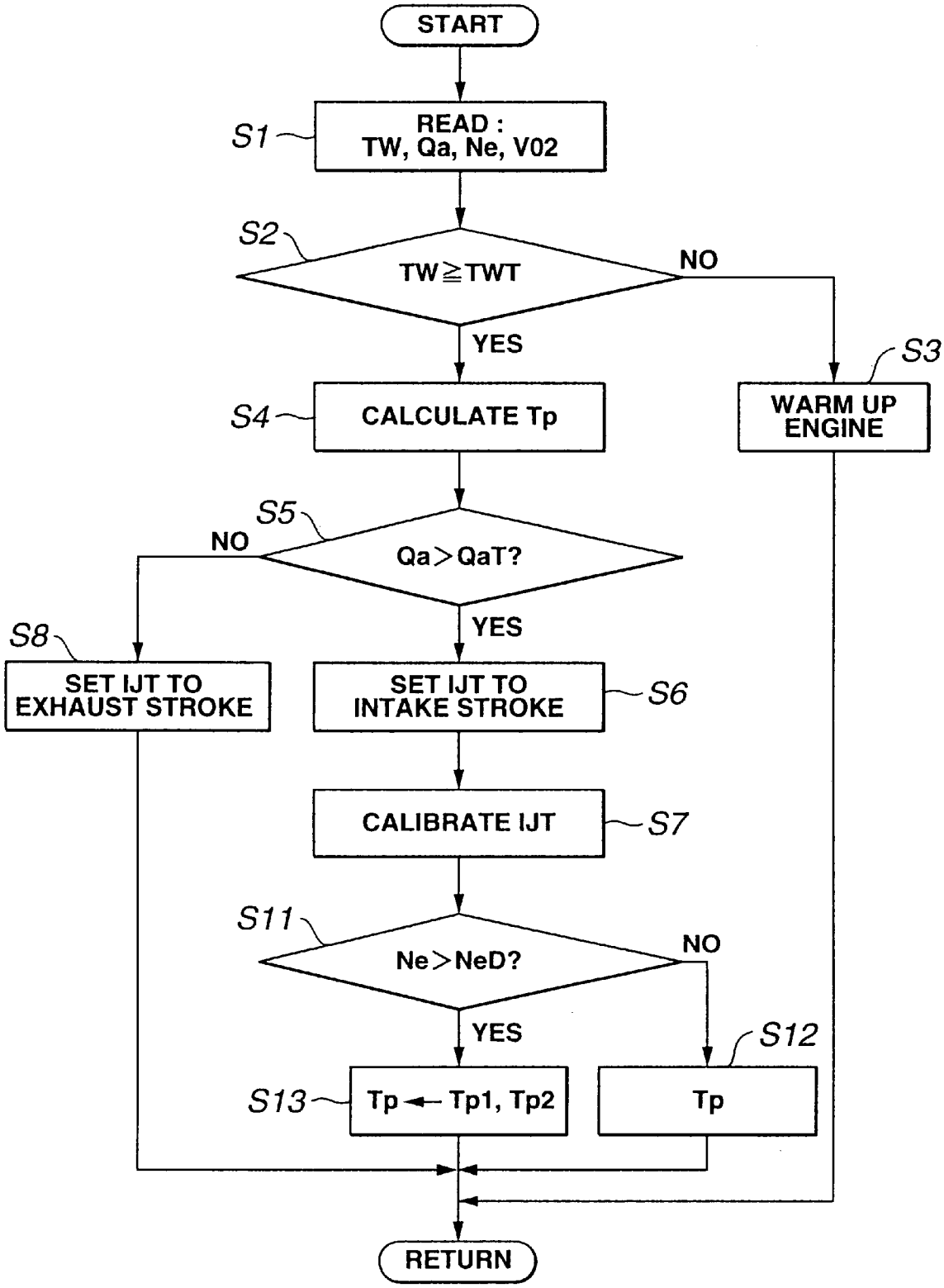
FIG. 5 is a flowchart illustrating a method of controlling fuel injection which is used in the second embodiment of the present invention.

Referring to FIGS. 4 and 5, an internal combustion engine of a second embodiment of the present invention is explained. The second embodiment differs from the first embodiment in provision of second fuel injector 25 upstream of fuel injector 11. Like reference numerals denote like parts, and therefore, detailed explanations therefor are omitted. As illustrated in FIG. 4, second fuel injector 25 is disposed at intake port 6 upstream of fuel injector 11. Second fuel injector 25 is arranged to inject fuel toward intake valve 12, and is in communication with controller 10 so as to be activated by controller 10. Controller 10 is programmed to split or divide fuel injection amount Tp into two parts Tp1 and Tp2 at a preset split ratio in response to the signal indicating that engine revolution number Ne is more than preset value NeD, and programmed to activate first and second fuel injectors 11 and 25 to inject parts Tp1 and Tp2, respectively. The preset split ratio, for instance, may be 50:50 in percent.

Specifically, when engine revolution number Ne is more than preset value NeD under condition that fuel injection timing IJT is set to engine intake stroke IJTin, it is difficult to have a sufficient time for vaporization of the injected fuel flowing into combustion chamber 7. In this embodiment, in the engine operating condition as described above, fuel injection amount Tp is split into one part Tp1 and the other part Tp2, and first fuel injector 11 is activated to inject one part Tp1 and second fuel injector 25 is activated to inject the other part Tp2. This can ensure the sufficient time for vaporization of the injected fuel when engine 1 operates in the high revolution range, and at the same time, reduce the temperature of the intake air flowing into combustion chamber 7. Although second fuel injector 25 is located farther remote from combustion chamber 7, the prolonged time required until the injected fuel enters into combustion chamber 7 will not cause any adverse influence on the engine operation in the high revolution range.

Referring to FIG. 5, a flow of the fuel injection control implemented in the second embodiment will be explained hereinafter, which is similar to the flow shown in FIG. 3 except for blocks S11 to S13. After calibration of fuel injection timing IJT at block S7, the logic flow goes to decision block S11. At decision block S11, an interrogation is made whether or not engine revolution number Ne is more than preset value NeD. If the interrogation made at decision block S11 is in negative indicating that engine revolution number Ne is not more than preset value NeD, it is determined that a sufficient time for vaporization of the injected fuel can be ensured up to the moment the injected fuel enters into combustion chamber 7. Then, the logic flow goes to block S12 at which fuel injection amount Tp calculated at block S4 is injected in entirety from downstream-side fuel injector 11 at engine intake stroke IJTin. If the interrogation made at decision block S11 is in affirmative indicating that engine revolution number Ne is more than preset value NeD, the logic flow goes to block S13. At block S13, fuel injection amount Tp calculated at block S4 is split into two parts Tp1 and Tp2 at the preset split ratio, and the two parts Tp1 and Tp2 are injected by downstream-side fuel injector 11 and upstream-side fuel injector 25, respectively, at engine intake stroke IJTin.

This application is based on a prior Japanese Patent Application No. 2001-087526 filed on Mar. 26, 2001, the entire content of which is hereby incorporated by reference.

Although the invention has been described above by reference to certain embodiments of the invention, the invention is not limited to the certain embodiments described above. Modifications and variations of the certain embodiments described above will occur to those skilled in the art in light of the above teachings. The scope of the invention is defined with reference to the following claims.

What is claimed is:

1. An internal combustion engine, comprising:

a combustion chamber;

an intake air passage communicated with the combustion chamber;

an intake valve having a thermal insulator at an air-exposure portion thereof which is opposed to the intake air passage, the intake valve being operative to establish fluid communication between the combustion chamber and the intake air passage and prevent the fluid communication therebetween;

a fuel injector operative to inject an amount of fuel toward the air-exposure portion of the intake valve at a fuel injection timing, the fuel injector being disposed within the intake air passage; and a controller in communication with the fuel injector and programmed to set the fuel injection timing of the fuel injector in an engine intake stroke.

2. The internal combustion engine as claimed in claim 1, wherein the fuel injector is designed to atomize the fuel to fine particles having an average particle diameter of not more than 100 $\mu$m.

3. The internal combustion engine as claimed in claim 1, wherein the fuel injector is designed to atomize the fuel to fine particles having an average particle diameter of not more than 80 $\mu$m.

4. An internal combustion engine, comprising:

a combustion chamber;

an intake air passage communicated with the combustion chamber;

an intake valve having a thermal insulator at an air-exposure portion thereof which is opposed to the intake air passage, the intake valve being operative to establish fluid communication between the combustion chamber and the intake air passage and prevent the fluid communication therebetween;

a fuel injector operative to inject an amount of fuel toward the air-exposure portion of the intake valve at a fuel injection timing, the fuel injector being disposed within the intake air passage; and a controller in communication with the fuel injector and programmed to set the fuel injection timing of the fuel injector in an engine intake stroke;

wherein the thermal insulator is made of ceramic.

5. An internal combustion engine, comprising:

a combustion chamber;

an intake air passage communicated with the combustion chamber;

an intake valve having a thermal insulator at an air-exposure portion thereof which is opposed to the intake air passage, the intake valve being operative to establish fluid communication between the combustion chamber and the intake air passage and prevent the fluid communication therebetween;

a fuel injector operative to inject an amount of fuel toward the air-exposure portion of the intake valve at a fuel injection timing, the fuel injector being disposed within the intake air passage; and a controller in communication with the fuel injector and programmed to set the fuel injection timing of the fuel injector in an engine intake stroke;

wherein the thermal insulator is made of resin.

6. An internal combustion engine, comprising:

a combustion chamber;

an intake air passage communicated with the combustion chamber;

an intake valve having a thermal insulator at an air-exposure portion thereof which is opposed to the intake air passage, the intake valve being operative to establish fluid communication between the combustion chamber and the intake air passage and prevent the fluid communication therebetween;

a fuel injector operative to inject an amount of fuel toward the air-exposure portion of the intake valve at a fuel injection timing, the fuel injector being disposed within the intake air passage;

a controller in communication with the fuel injector and programmed to set the fuel injection timing of the fuel injector in an engine intake stroke; and a sensor in communication with the controller and generating a signal indicative of a parameter relative to an engine load, the controller being programmed to set the fuel injection timing to the engine intake stroke in response to the signal indicating that the parameter is more than a threshold value, and set the fuel injection timing to an engine exhaust stroke in response to the signal indicating that the parameter is not more than the threshold value.

7. An internal combustion engine, comprising:

a combustion chamber;

an intake air passage communicated with the combustion chamber;

an intake valve having a thermal insulator at an air-exposure portion thereof which is opposed to the intake air passage, the intake valve being operative to establish fluid communication between the combustion chamber and the intake air passage and prevent the fluid communication therebetween;

a fuel injector operative to inject an amount of fuel toward the air-exposure portion of the intake valve at a fuel injection timing, the fuel injector being disposed within the intake air passage;

a controller in communication with the fuel injector and programmed to set the fuel injection timing of the fuel injector in an engine intake stroke; and a sensor in communication with the controller and generating a signal indicative of a parameter relative to an engine revolution number, the controller being programmed to advance the fuel injection timing in response to the signal indicating that the parameter increases under condition that the fuel injection timing is set to the engine intake stroke.

8. An internal combustion engine, comprising:

a combustion chamber;

an intake air passage communicated with the combustion chamber;

an intake valve having a thermal insulator at an air-exposure portion thereof which is opposed to the intake air passage, the intake valve being operative to establish fluid communication between the combustion chamber and the intake air passage and prevent the fluid communication therebetween;

a fuel injector operative to inject an amount of fuel toward the air-exposure portion of the intake valve at a fuel injection timing, the fuel injector being disposed within the intake air passage;

a controller in communication with the fuel injector and programmed to set the fuel injection timing of the fuel injector in an engine intake stroke; and a sensor in communication with the controller and generating a signal indicative of a parameter relative to an engine revolution number, and a second fuel injector disposed upstream of the fuel injector and in communication with the controller, the controller being programmed to split the amount of fuel into two parts and activate the fuel injector and the second fuel injector to inject the two parts of the amount of fuel, respectively, in response to the signal indicating that the parameter is more than a preset value.

9. The internal combustion engine as claimed in claim 8, wherein the controller is programmed to activate the fuel injector to inject the amount of fuel in entirety in response to the signal indicating that the parameter is not more than the preset value.

10. An internal combustion engine, comprising:

a combustion chamber;

an intake air passage communicated with the combustion chamber;

an intake valve having a thermal insulator at an air-exposure portion thereof which is opposed to the intake air passage, the intake valve being operative to establish fluid communication between the combustion chamber and the intake air passage and prevent the fluid communication therebetween;

a fuel injector operative to inject an amount of fuel toward the air-exposure portion of the intake valve at a fuel injection timing, the fuel injector being disposed within the intake air passage; and a controller in communication with the fuel injector and programmed to set the fuel injection timing of the fuel injector in an engine intake stroke;

wherein the controller is further programmed to determine whether or not the engine operates in a knock range, and set the fuel injection timing of the fuel injector to the engine intake stroke when it is determined that the engine operates in the knock range.

11. The internal combustion engine as claimed in claim 10, wherein the controller is further programmed to set the fuel injection timing of the fuel injector to an engine exhaust stroke when it is determined that the engine operates out of the knock range.

12. A method of controlling fuel injection for knock suppression in an internal combustion engine which has an intake air passage, an intake valve having an air-exposure portion opposed to the intake air passage, and a fuel injector adapted to inject an amount of fuel toward the air-exposure portion of the intake valve, the method comprising:

determining whether or not the engine operates in a warmed-up state;

determining whether or not the engine operates in a knock range under condition that the engine operates in the warmed-up state; and setting a fuel injection timing at which the fuel injector injects the amount of fuel, in an engine intake stroke when it is determined that the engine operates in the knock range;

wherein the intake valve has a thermally insulated portion at the air-exposure portion.

13. A method of controlling fuel injection for knock suppression in an internal combustion engine which has an intake air passage, an intake valve having an air-exposure portion opposed to the intake air passage, and a fuel injector adapted to inject an amount of fuel toward the air-exposure portion of the intake valve, the method comprising:

determining whether or not the engine operates in a warmed-up state;

determining whether or not the engine operates in a knock range under condition that the engine operates in the warmed-up state;

setting a fuel injection timing at which the fuel injector injects the amount of fuel, in an engine intake stroke when it is determined that the engine operates in the knock range; and detecting a first parameter relative to an amount of intake air flowing into the intake air passage, wherein the determination that the engine operates in the knock range is made when the first parameter is more than a threshold value.

14. The method as claimed in claim 13, further comprising setting the fuel injection timing to an engine exhaust stroke when it is determined that the engine operates out of the knock range, the determination that the engine operates out of the knock range being made when the first parameter is not more than a threshold value.

15. The method as claimed in claim 13, further comprising detecting a second parameter relative to an engine revolution number.

16. The method as claimed in claim 15, further comprising calibrating the fuel injection timing set to the engine intake stroke so as to advance as the second parameter increases.

17. The method as claimed in claim 15, wherein the engine includes a second fuel injector disposed upstream of the first fuel injector.

18. The method as claimed in claim 17, further comprising calculating the amount of fuel, determining whether or not the second parameter is more than a preset value, splitting the amount of fuel into two parts and activating the first and second fuel injectors to respectively inject the two parts of the amount of fuel when it is determined that the second parameter is more than the preset value.

19. The method as claimed in claim 18, further comprising activating the first fuel injector to inject the amount of fuel in entirety when it is determined that the second parameter is not more than the preset value.

20. An internal combustion engine, comprising:

a combustion chamber;

an intake air passage communicated with the combustion chamber;

an intake valve having a thermal insulator at an air-exposure portion thereof which is opposed to the intake air passage, the intake valve being operative to establish fluid communication between the combustion chamber and the intake air passage and prevent the fluid communication therebetween;

a fuel injector operative to inject an amount of fuel toward the air-exposure portion of the intake valve at a fuel injection timing, the fuel injector being disposed within the intake air passage; and control means, in communication with the fuel injector, for setting the fuel injection timing of the fuel injector in an engine intake stroke on the basis of an engine load.

* * * * *